US008016327B2

(12) United States Patent
Dinh et al.

(10) Patent No.: US 8,016,327 B2
(45) Date of Patent: Sep. 13, 2011

(54) BIFURCATED LATCHING SYSTEM

(75) Inventors: Tan Dinh, Fountain Valley, CA (US); Khusro Jhumra, Yorba Linda, CA (US)

(73) Assignee: Hartwell Corporation, Placentia, CA (US)

( * ) Notice: Subject to any disclaimer, the term of this patent is extended or adjusted under 35 U.S.C. 154(b) by 522 days.

(21) Appl. No.: 11/835,957

(22) Filed: Aug. 8, 2007

(65) Prior Publication Data

US 2008/0067818 A1 Mar. 20, 2008

Related U.S. Application Data

(60) Provisional application No. 60/836,502, filed on Aug. 9, 2006.

(51) Int. Cl.
*E05C 19/00* (2006.01)
*E05C 19/18* (2006.01)

(52) U.S. Cl. ..... 292/1; 292/288; 70/18; 70/58

(58) Field of Classification Search ..... 292/1, 32, 292/38, 42, 288, 292, DIG. 11; 70/18, 30, 70/49, 53, 58
See application file for complete search history.

(56) References Cited

U.S. PATENT DOCUMENTS

| | | | | |
|---|---|---|---|---|
| 1,768,021 | A | 6/1930 | Bauerband | |
| 2,216,367 | A * | 10/1940 | Hoblick | 292/1 |
| 2,752,183 | A * | 6/1956 | Doll | 292/1 |
| 3,754,224 | A * | 8/1973 | Roy et al. | 340/541 |
| 3,765,196 | A * | 10/1973 | Balicki | 70/49 |
| 4,075,878 | A * | 2/1978 | Best | 70/49 |
| 4,421,349 | A | 12/1983 | Greiert | |
| 5,096,236 | A * | 3/1992 | Thony | 292/32 |
| 5,172,945 | A | 12/1992 | Doherty et al. | |
| 5,560,232 | A * | 10/1996 | Chen | 70/30 |
| 5,568,740 | A * | 10/1996 | Lin | 70/49 |
| 5,992,187 | A * | 11/1999 | Derman | 70/58 |
| 6,026,664 | A * | 2/2000 | Lin | 70/49 |
| 6,068,305 | A * | 5/2000 | Myers et al. | 292/201 |
| 6,116,663 | A * | 9/2000 | Robert | 292/153 |
| 6,457,336 | B1 * | 10/2002 | Bremicker | 70/34 |
| 6,508,086 | B2 * | 1/2003 | Chen | 70/49 |
| 6,923,027 | B1 * | 8/2005 | Kuo | 70/49 |
| 7,513,133 | B2 * | 4/2009 | Muerza | 70/233 |
| 2002/0073747 | A1 * | 6/2002 | Chen | 70/49 |
| 2005/0235710 | A1 * | 10/2005 | Ling | 70/58 |
| 2006/0038410 | A1 | 2/2006 | Pratt et al. | |
| 2007/0169523 | A1 * | 7/2007 | Lu | 70/58 |

FOREIGN PATENT DOCUMENTS

| | | | |
|---|---|---|---|
| CH | 676832 | A5 * | 3/1991 |
| DE | 3707323 | A1 * | 9/1988 |
| DE | 29514280 | U1 | 11/1995 |
| GB | 2161532 | A | 1/1986 |
| WO | WO 2006/004942 | | 1/2006 |
| WO | WO 2006/033929 | | 3/2006 |

OTHER PUBLICATIONS

Search Report issued in application No. EP 07290991 (2009).

* cited by examiner

*Primary Examiner* — Carlos Lugo
(74) *Attorney, Agent, or Firm* — Barnes & Thornburg LLP

(57) ABSTRACT

A bifurcated latching system for securing together first and second portions of an aircraft, the bifurcated latching system comprising a pin latch assembly and a pawl latch assembly. The pin latch assembly comprises a pin latch receptacle and a pin in mating engagement. The pawl latch assembly comprises a pawl latch receptacle and a pawl latch pin in mating engagement. The pawl latch assembly further comprises one or more pawls configured to releasably secure the matting engagement of the pawl latch receptacle and the pawl latch pin.

20 Claims, 9 Drawing Sheets

BIFURCATED LATCHING SYSTEM

CROSS REFERENCE TO RELATED APPLICATIONS

This patent application claims the benefit of priority under 35 U.S.C. §119(e) to U.S. Provisional Application Ser. No. 60/836,502, filed Aug. 9, 2006. The disclosure set forth in the referenced provisional application is incorporated herein by reference in its entirety, including all information as originally submitted to the United States Patent and Trademark Office.

BACKGROUND

This disclosure relates generally to latches for use in aerospace applications such as those used on aircraft to hold structures or other portions of a housing in a secured or closed position.

Many latches are available in the aerospace industry for holding structures or other portions of a housing or the like of an aircraft in a closed position even when the structures are subjected to significant forces. Aerospace industry latches may be used, for example, to hold the housing portions of an engine nacelle in the closed position around the engine mechanisms. The latches undergo significant forces and must be designed to hold the portions of the nacelle in a closed position during operation. Additionally, the latches must be operable so that the nacelles can be opened for access to the engine mechanism or engine component.

Features and advantages of the disclosure will be set forth in part in the description which follows and the accompanying drawings described below, wherein an embodiment of the disclosure is described and shown, and in part will become apparent upon examination of the following detailed description taken in conjunction with the accompanying drawings.

SUMMARY

A bifurcated latching system for securing together first and second portions of an aircraft comprising a pin latch assembly and a pawl latch assembly. The pin latch assembly may comprise a pin latch receptacle and a pin matingly engageable with each other. The pawl latch assembly may comprise a pawl latch receptacle, a pawl latch pin matingly engageable with each other, and one or more pawls for releasably securing the mating engagement of the pawl latch receptacle and the pawl latch pin.

BRIEF DESCRIPTION OF THE DRAWINGS

The present disclosure will be described hereinafter with reference to the attached drawings which are given as a non-limiting example only, in which.

DETAILED DESCRIPTION

Figure 1:
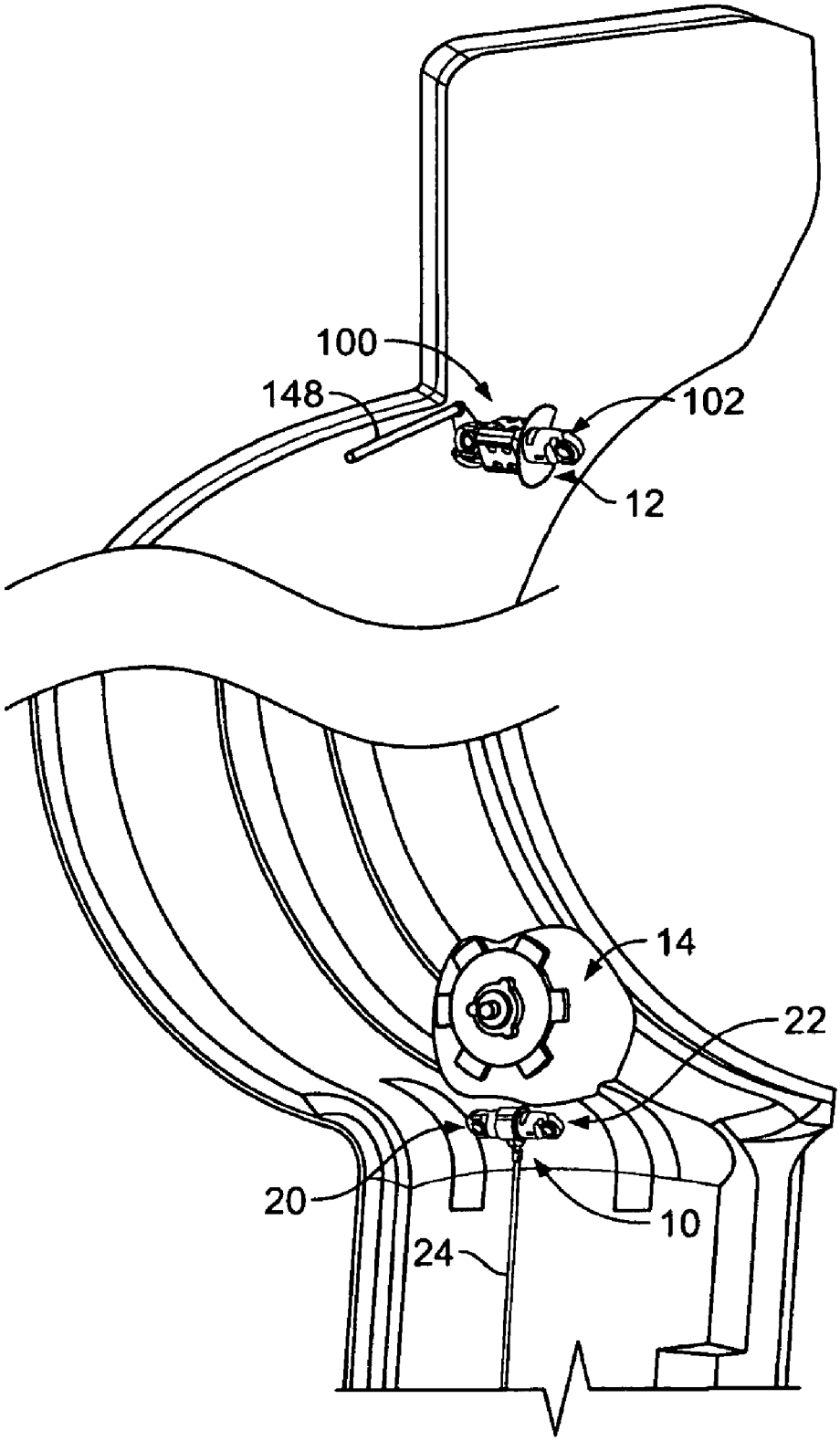
FIG. 1 is a simplified view of a bifurcated latching system in accordance with an illustrated embodiment of the present disclosure secured to a cowling of an aircraft.
Figure 2:
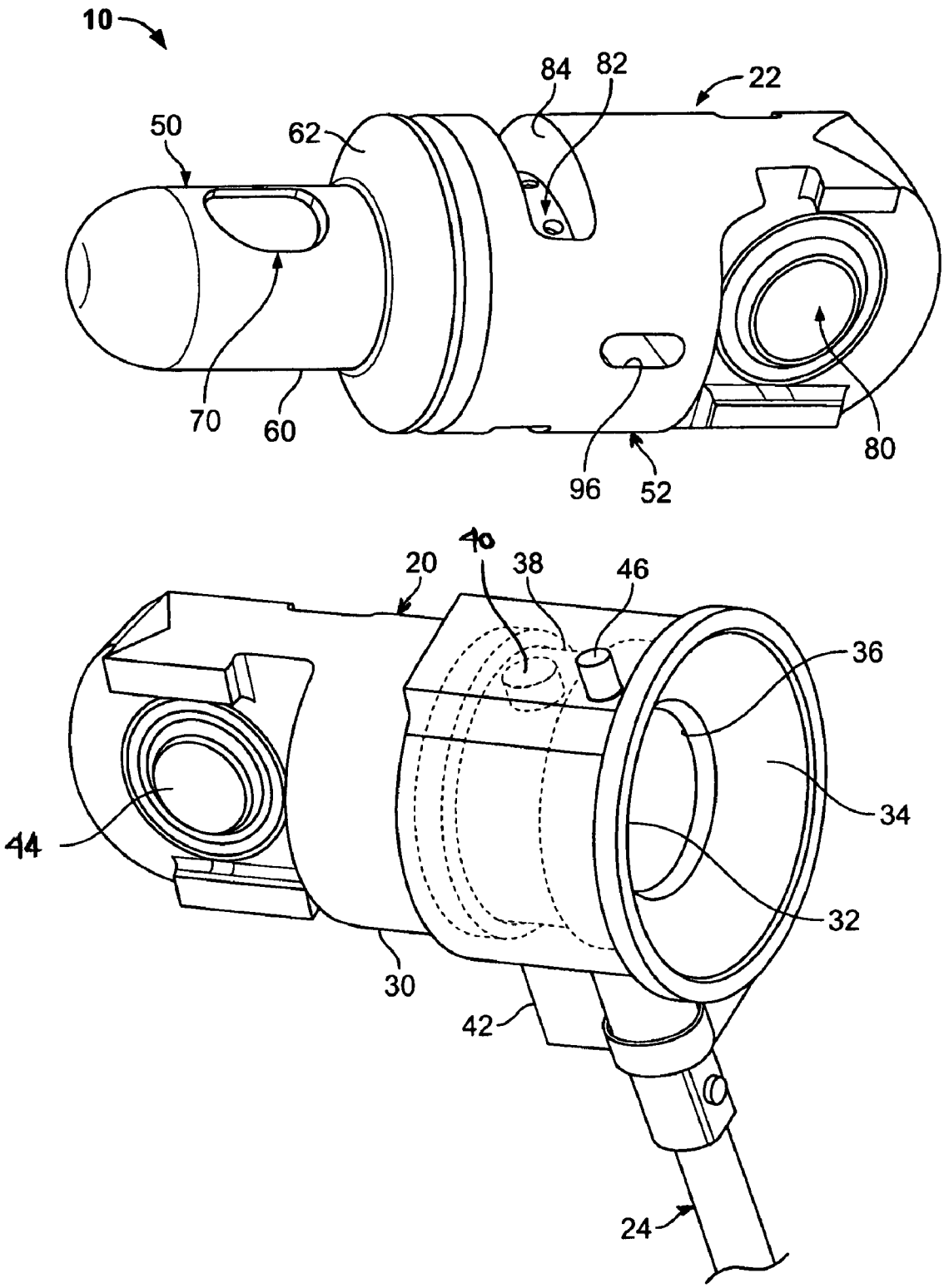
FIG. 2 is a perspective view of a pin latch receptacle and a pin member of a pin latch assembly of FIG. 1 disengaged from each other and a partial view of a pin rod of the pin latch assembly engaged with the pin latch receptacle.
Figure 3:
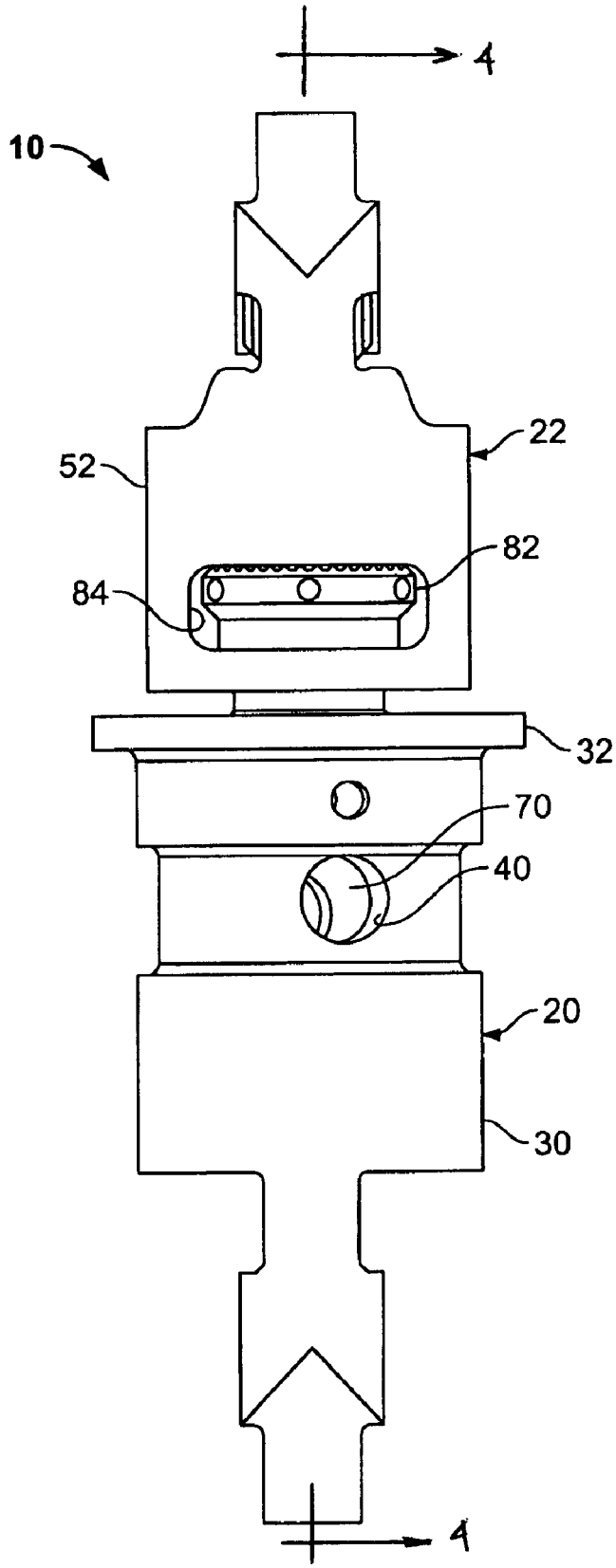
FIG. 3 is a top plan view of the pin latch receptacle and the pin member of a pin latch assembly of FIG. 1 matingly engaged with each other, with a shear pin guide removed.
Figure 4:
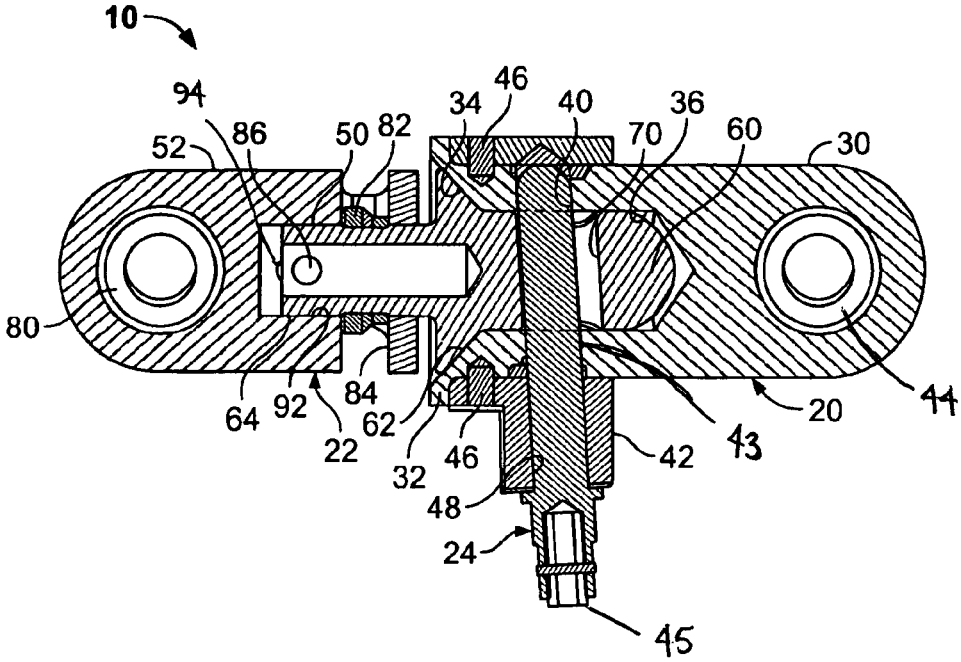
FIG. 4 is a cross section of the pin latch assembly of FIGS. 1 and 3 taken generally along line 4-4 in FIG. 3, in an engaged position.
Figure 5:
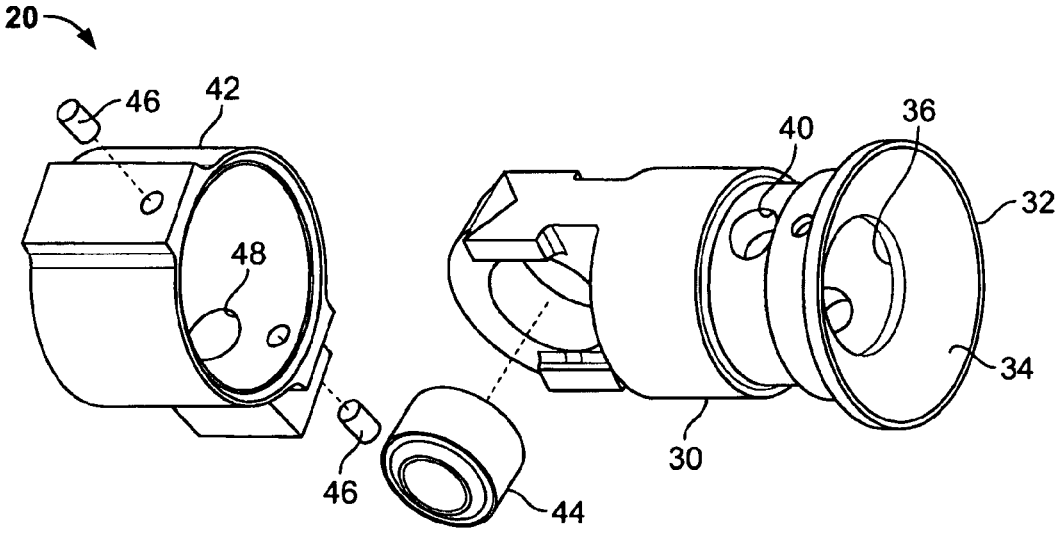
FIG. 5 is an exploded view of the pin latch receptacle of the pin latch assembly of FIG. 1.

The exemplification set out herein illustrates embodiments of the disclosure that is not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

While the present disclosure may be susceptible to embodiment in different forms, there is shown in the drawings, and herein will be described in detail, an embodiment with the understanding that the present description is to be considered an exemplification of the principles of the disclosure and is not intended to limit the disclosure to the details of construction, methods and the arrangements of components set forth in the following description or illustrated in the drawings.

The present disclosure is directed to a bifurcated latching system for holding structures or other portions of a vehicle, such as, by way of example and not limitation an aircraft in a secured or closed position. The vehicle may be in the form of an aircraft including, but not limited to, a plane, jet, helicopter or any other aerospace vehicle. Other vehicles may benefit from use of this system such as, but not limited to, marine, land, mining and other space vehicles. The structures held in the secured position may include any suitable structures configured to be closed or otherwise secured together.

FIGS. 1-11, for example, disclose a bifurcated latching system in accordance with an illustrative embodiment of the present disclosure, by way of example and not limitations, for closing a cowling of an aircraft. The bifurcated latching system in accordance with the illustrative embodiment includes a pin latch assembly 10 and a pawl latch assembly 12. The pin latch assembly 10 and the pawl latch assembly 12 may be spaced apart from each other any suitable dimension. The pin latch assembly 10 is located below the pawl latch assembly 12. The cowling may house any type of aircraft component 14 such as, by way of example and not limitation, an engine component, engine, or any other type of aircraft component.

In the illustrative embodiment, the pin latch assembly 10 includes a pin latch receptacle 20, a pin member 22 matingly engageable with the pin latch receptacle 20, and a pin rod 24 matingly engageable with the pin latch receptacle 20 and the pin member 22 to secure in mating engagement the pin latch receptacle 20 and the pin member 22. The pin latch receptacle 20 comprises a body 30 including a generally conical-shaped guide member 32 defining a guide bore 34. The body 30 of the pin latch receptacle 20 defines a cylindrical chamber 36 contiguous with the guide bore 34. The guide member 32 directs the pin member 22 from the guide bore 34 toward the cylindrical chamber 36 for mating engagement with the pin latch receptacle 20. The pin latch receptacle 20 defines an annular recess 38. The pin latch receptacle 20 also defines a pin rod channel 40 contiguous with the cylindrical chamber 36 but generally extending almost perpendicular to the cylindrical chamber. The pin latch receptacle 20 also includes a shear pin guide 42 disposed about the body 30, fasteners, such as rivets 46 for securing the shear pin guide about the body 30, and a spherical bearing 44 for securement of the pin latch receptacle 20 to the cowling or other structure. The shear pin guide 42 defines a hole 48 adapted to align with the pin rod channel 40.

The pin rod 24 includes a generally ridged pin end 43 which is attached to a generally flexible rod structure 45. The pin end 43 provides a ridged structure which can extend through the hole 48 and pin rod channel 40, and 70 for engaging and retaining the pin latch assembly 10 with the pin latched receptacle 20. The generally flexible rod structure allows this mechanism to be extended to another location with the rod structure being relatively flexible for accommodating somewhat non-linear paths. Operation of the pin rod 24 is achieved by manipulating the rod structure 45 to affect a movement of the pin end 43 for engaging and disengaging the corresponding holes and channels 48, 40, and 70.

The pin member 22 of the pin latch assembly 10 includes an engagement member 50 and a support member 52. The engagement member 50 includes a pin 60, a flange 62, and a support leg 64 coupled to the support member 52. The pin 60 defines a pin rod channel 70 extending generally almost perpendicular to the pin. The pin 60 is configured to matingly engage the pin latch receptacle 20, by receipt of the pin into the cylindrical chamber 36 of the pin latch receptacle 20. Upon such mating engagement, the flange 62 is engaged with the guide member 32 of the pin latch receptacle 20, and the pin rod 24 channel is aligned with the pin rod channel 40 of the pin latch receptacle 20. The pin rod 24 is inserted through the pin rod channels 40 and 70 and the hole 66 of the shear pin guide 42 to releasably secure together in mating engagement the pin latch receptacle 20 and the pin member 22. In the illustrated embodiment, the pin rod channel 70 of the pin member 22 is generally oval shaped and has a cross section or inside diameter that is greater than the cross section or outside diameter of the pin rod channel 40 of the pin latch receptacle 20 to accommodate engagement, manufacturing tolerances, and stress conditions.

The pin member 22 further includes a spherical bearing 80 engaged with the support member 52 for securement to a keeper or other aircraft structure, an adjustment nut 82 retained in a slot 84 defined by the support member 52, a step pin 86 to secure together the pin 60 and the support member 52, and securement pins 90 for securing together various components of the pin member 22. The support leg 64 of the pin member 22 is received by a bore 92 defined by the support member 52, and the step pin 86 extends through a slot 94 defined by the support member and the holes 96 defined by the support leg 64 of the pin member 22 to couple the engagement member 50 and the support member 52.

Figure 6:
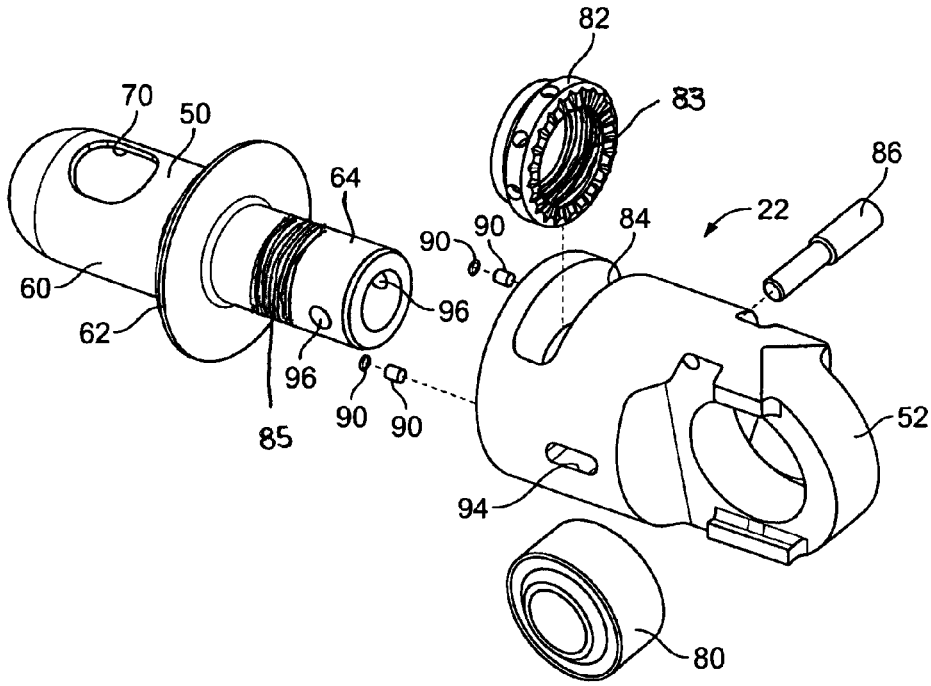
FIG. 6 is an exploded view of the pin member of the pin latch assembly of FIG. 1.
Figure 7:
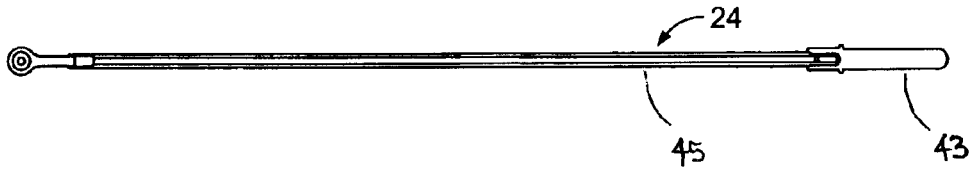
FIG. 7 is a top plan view of the pin rod of the pin latch assembly of FIG. 1.
Figure 8:
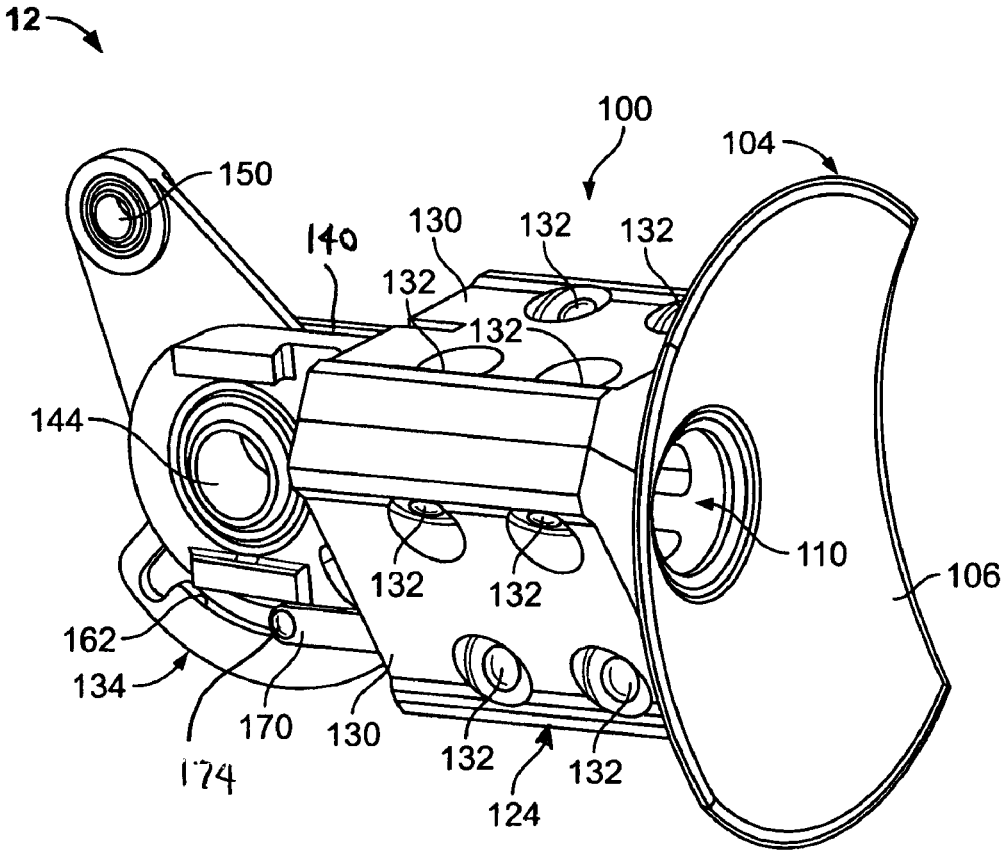
FIG. 8 is a perspective view of a pawl latch assembly of FIG. 1, illustrating a pawl latch receptacle disengaged from a pawl latch pin member.
Figure 8:
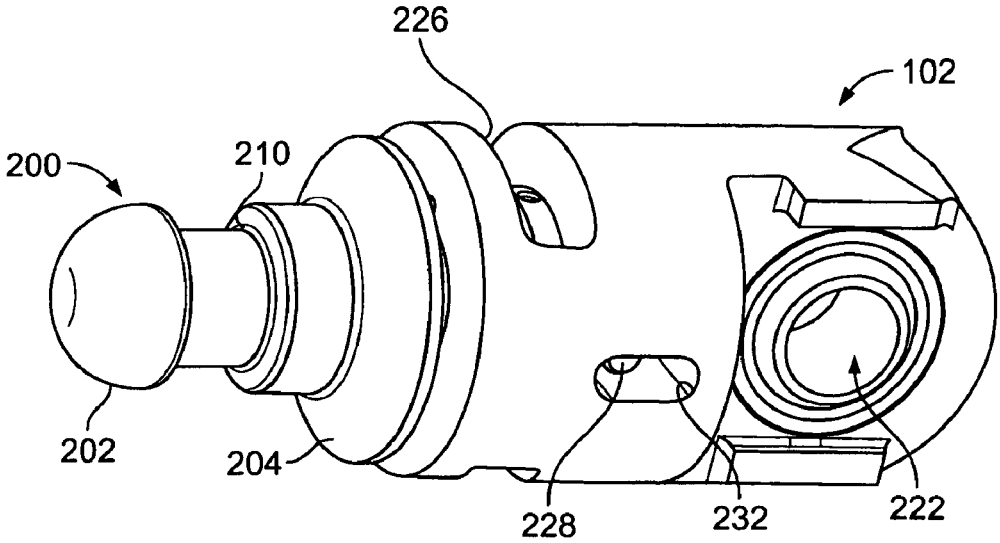
Figure 9:
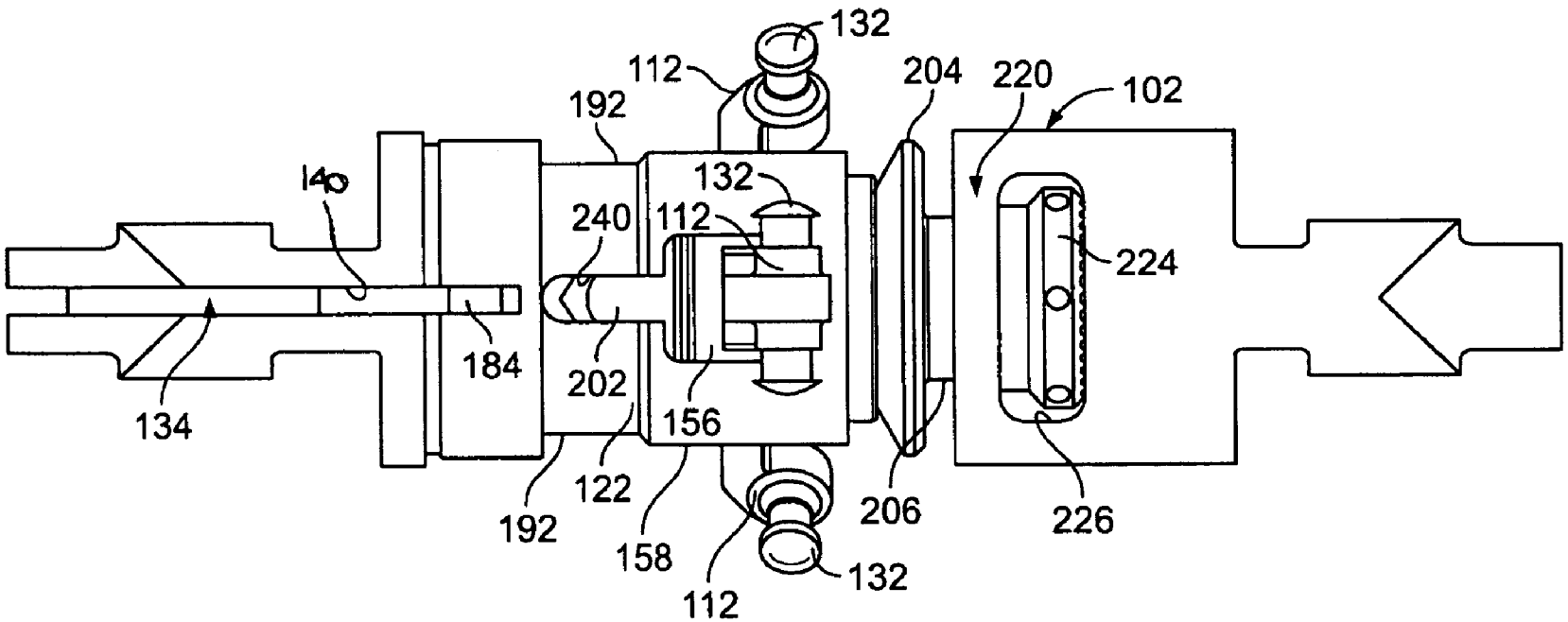
FIG. 9 is a top plan view of the pawl latch assembly in an engaged position with a sleeve, housing members and other structure of the pawl latch receptacle removed to illustrate the pawls in an engaged position.
Figure 10:
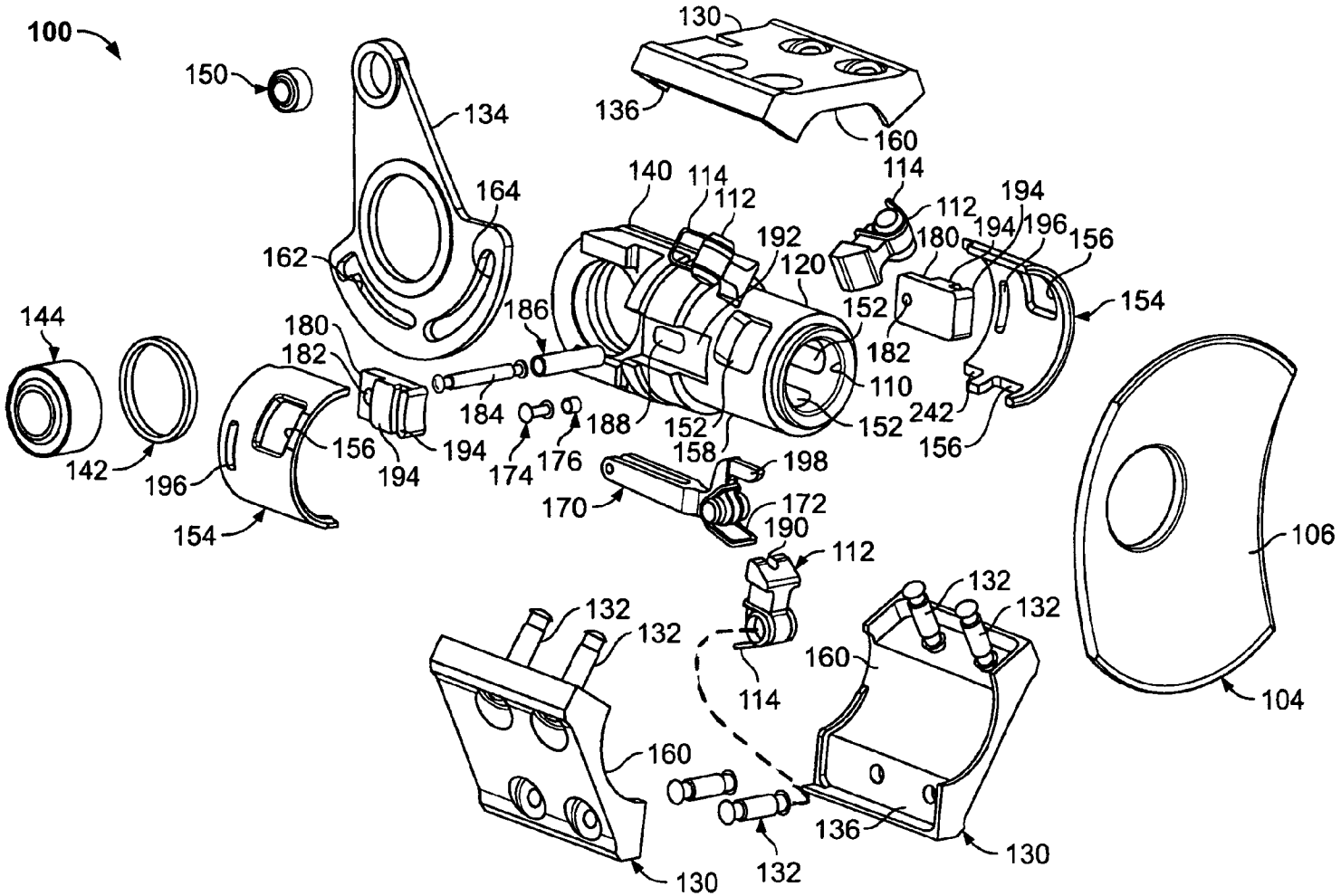
FIG. 10 is an exploded view of the pawl latch receptacle of the pawl latch assembly of FIG. 1.
Figure 11:
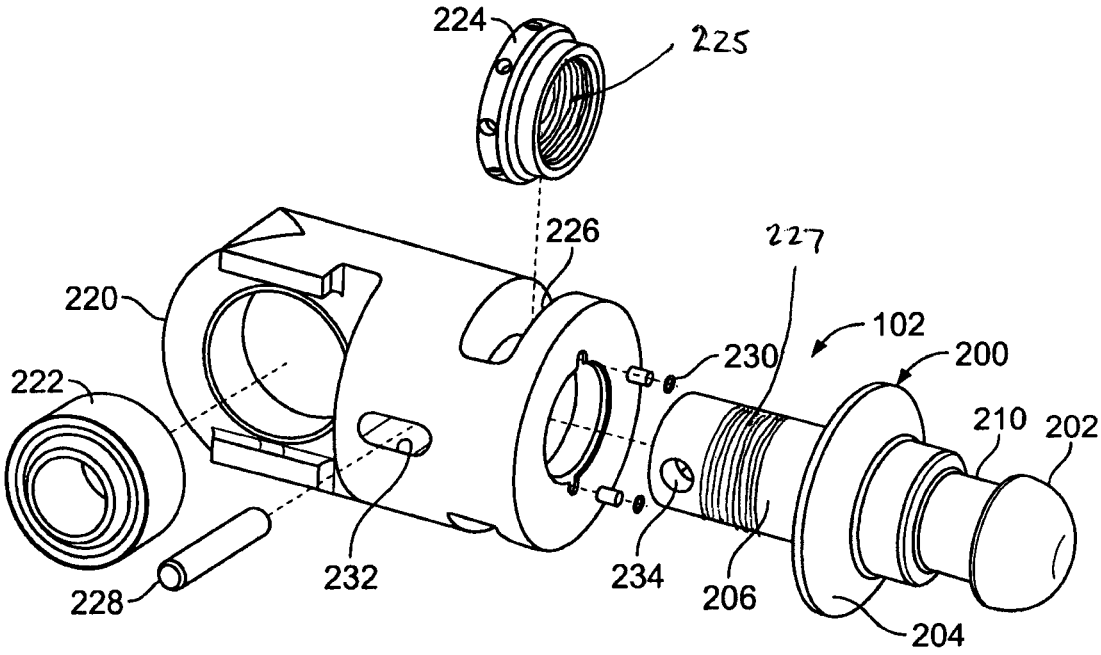
FIG. 11 is an exploded view of the pawl latch pin of the pawl latch assembly of FIG. 1.

As shown in FIG. 6, the adjustment nut 82 includes a threaded surface 83 which engages a corresponding threaded surface 85 on an external surface of the support leg 64. When the support leg is inserted into the support member 52 the nut 82 is threadedly engaged with leg 64. Adjustment of the nut relative to the leg axially advances or retracts the pin 60 relative to the support 52. Motion is limited by engagement of the pin 86 in the holes 96 and elongated slots 94. The elongation of the slot 94 allows for some axial movement of the pin 60.

The pin rod 24 may have any suitable structure and configuration. The pin rod 24 is configured to releasably lock in mating engagement the pin latch receptacle 20 and the pin member 22 by extending through the hole 48 of the shear pin guide 42, the channel 40 of the pin latch receptacle 20, and the channel 70 of the pin member 22. The pin rod 24 may be selectively removed from the pin rod channels 40 and 70 to thereby release the pin member 22 from the pin latch receptacle 20. The pin latch assembly 10 may have any other suitable construction and the pin latch receptacle 20 and the pin member 22 may be matingly engageable or otherwise engageable with each other in any other suitable manner in accordance with other embodiments of the present disclosure.

In the illustrative embodiment of FIGS. 8-11, the upper pawl latch assembly 12 includes a pawl latch receptacle 100 and a pawl latch pin member 102 matingly engageable with the pawl latch receptacle. The pawl latch receptacle 100 includes a generally truncated conical shaped guide member 104 defining a guide bore 106 and defines a generally cylindrical chamber 110 contiguous with the guide bore. The guide member 104 directs the pawl latch pin member 102 from the guide bore 104 toward the cylindrical chamber 110. The pawl latch receptacle 100 includes three pawls 112 (FIGS. 9&10) that are biased by springs 114 or by any other suitable manner or mechanism toward a locked or otherwise engaged position in which they are engaged with the pawl latch pin member 102 within the chamber 110 of the pawl latch receptacle 100.

The pawl latch receptacle 100 further includes a receiver 120; a sleeve member 122 disposed about the receiver and slidable relative to the receiver and the pawls 112; a housing 124 comprised of three housing members 130 secured together by fasteners, such as step rivets 132; and a latch cam 134 coupled to the sleeve 122. One of the rivets 132 (e.g., the forward rivet associated with each housing member 130, FIG. 10) is also coupled to a respective pawl 112 and spring 114. The housing members 130 define voids 136 for receiving the pawls 112 and the springs 114. The springs 114 are engaged with the housing members 130. The sleeve 122 is received by or otherwise positioned relative to an annular void 158 defined by the receiver 120.

Rotation of the latch cam 134 causes the sleeve 122 to slide or shift generally coaxially relative to the pawl 112 and along the receiver 120 (along and within void 158) of the pawl latch receptacle 100. The sleeve 122 contacts and pivots or otherwise rotates or moves the pawls 112 from their locked or engaged positions such that the pawls disengage the pawl latch pin member 102 and pivot outside the chamber 110 of the pawl latch receptacle 100.

The latch cam 134 is received in a slot 140 defined by the receiver 120 and is coupled to the receiver by a spacer 142 and a spherical bearing 144. The latch cam 134 also includes a spherical bearing 150 for coupling to a push-pull cable 148 (FIG. 1) or the like. The receiver 120 defines three apertures 152 receiving the pawls. The sleeve 122 is comprised of two interlocking sleeve members 154 and also defines three apertures 156 for receiving the pawls 112. The housing members 130 define arcuate recesses 160 for receivably engaging the sleeve members 154. The latch cam 134 defines a pair of camming slots 162 and 164. The pawl latch receptacle 100 further includes a sensor arm 170 biased by a spring 172 and slidably received by the camming slot 162; a rivet 174 and roller 176 coupling the sensor arm 170 to the latch cam 134; a pair of guides 180 engaged with the sleeve members 154 and defining holes 182; and a step rivet 184 and a roller 186 extending through the holes 182, through an axially elongated slot 188 defined by the receiver 120, and through the camming slot 164. The guides 180 are received by voids 192 defined by the receiver and include engaging lips 194 engaging the sleeve members 154 at slots 196 defined by the sleeve members. One of the pawls 112 may define a void 190 for engaging an arm 198 of the sensor 170 arm when the pawls are in a disengaged position.

The pawl latch pin member 102 has a pin 200 that includes a generally, at least partially arcuate or conical hemispherical head 202, a flange 204, and a support leg 206. The pin 200 defines an annular groove 210 for receiving and engaging the pawls 112 when the pin member 102 is engaged with the latch receptacle 100. The pawl latch pin member 102 also includes a support member 220, a spherical bearing 222 engaged with the support member 220 for securement to a keeper, an adjustment nut 224 retained in a slot 226 defined by the support member 220 and a step pin 228 to secure together the pin and the support member, and securement pins 220. The step pin 228 extends through an elongated slot 232 defined by the support member 220 and holes 234 defined by the support leg 206 of the pawl latch pin member 102.

The adjustment nut 224 includes a threaded surface 225 on the inside opening thereof. Corresponding threads are formed on an exterior surface of the pin 200 along the support leg 206. Threaded engagement of the nut 224 with the leg 206 allows for some degree of axial displacement for adjusting the position of the pin 200 relative to the support member 220. Movement is limited by engagement of the step pin 228 with the holes 234 and elongated slot 232.

The receiver 120 defines a slot 240 contiguous with one of the three apertures 152 of the receiver for receiving the arm 198 of the sensor arm 170. The sleeve 122 defines an aperture 242 adjacent one of the three apertures 156 for receiving the arm 198 into the receiver 120. Thus, the sensor arm 170 is received within the voids 136 of the housing member, and the arm 198 of the sensor arm 170 extends into the aperture 242 of the sleeve 122 and into the slot 240 of the receiver 120.

In the illustrated embodiment, as the pin 200 of the pawl latch pin member 102 is inserted into the chamber 110 of the pawl latch receptacle 100, the head of the pin 202 pivots or otherwise moves the pawls 112 from the locked or engaged position toward an unlocked position whereby the pawls are outside the chamber 110. Once the pin 200 is fully inserted into the chamber 110, the pawls 112 rotate to their locked or engaged positions and are received by the annular groove 210 of the pin due to the biasing action of the springs 114. The pawls 112 engaged in the groove 210 prevent unintentional removal of the pin 200 from the pawl latch receptacle 100.

The pawl latch pin member 102 can be disengaged from the pawl latch pin receptacle by rotating the latch cam 134. Such rotation causes the sleeve 122 to axially shift or slide relative to the pawls and along the receiver 120 of the pawl latch receptacle 100, and to contact and pivot the pawls 112 from their locked or engaged positions such that the pawls disengage the pin 200 of the pawl latch pin member 22 and pivot outside the chamber 110 of the pawl latch receptacle 100. The arm 198 of the sensor arm 170 may slide or otherwise move into the slot 190 of one of the pawls 112 as the pawls pivot outside the chamber.

The pawl latch assembly 12 may have any other suitable construction in accordance with other embodiments of the present disclosure. Additionally, the pawl latch receptacle 100 and the pawl latch pin member 102 may be matingly engageable, and the pawls 112 may be biased by any other means or be assembled or constructed in any other suitable manner in accordance with other embodiments.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the disclosure are desired to be protected. The description and figures are intended as illustrations of embodiments of the disclosure, and are not intended to be construed as containing or implying limitation of the disclosure to those embodiments. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

The invention claimed is:

1. A bifurcated latching system for securing together first and second portions of an aircraft structure, the bifurcated latching system comprising: (a) a pin latch assembly comprising a pin latch receptacle having a first end for attachment to one of the first and second portions and an opposed second end, a pin having a first end for attachment to the other of the first and second portions and an opposed second end, the pin latch receptacle receiving the second end of the pin in mating relation, and locking means to secure the pin latch receptacle to the pin; and (b) a pawl latch assembly comprising a pawl latch receptacle having a first end for attachment to one of the first and second portions and an opposed second end defining a receptacle bore, and including at least one pawl, a pawl latch pin having a first end for attachment to the other of the first and second portions and an opposed second end, means for biasing the at least one pawl to an engaged position, the pawl latch receptacle bore matingly receiving the second end of the pawl latch pin, the at least one pawl biased by the biasing means to engage the pawl latch pin when the pawl latch pin is matingly received by the pawl latch receptacle bore to secure in mating engagement the pawl latch receptacle and the pawl latch pin.

2. The bifurcated latching system of claim 1 wherein including at least three pawls.

3. The bifurcated latching system of claim 1 wherein the biasing means comprises a spring.

4. A bifurcated latching system for securing together first and second portions of a structure, the bifurcated latching system comprising: (a) a pin latch assembly comprising a pin latch receptacle having a first end for attachment to one of the first and second portions and a pin having a second end for attachment to the other of the first and second portions, the pin latch receptacle receiving the pin in mating relation, and locking means to secure the pin latch receptacle to the pin; and (b) a pawl latch assembly comprising a pawl latch receptacle having a first end for attachment to one of the first and second portions and including at least one pawl, the pawl latch receptacle comprises a sleeve defining an aperture receiving the pawl, the sleeve slidable relative to the pawl, a pawl latch pin having a second end for attachment to the other of the first and second portions, and means for biasing at least one pawl to an engaged position, the pawl latch receptacle defining a pawl latch receptacle bore to matingly receive the pawl latch pin, at least one pawl biased by the biasing means to engage the pawl latch pin when the pawl latch pin is matingly received by the pawl latch receptacle bore to secure in mating engagement the pawl latch receptacle and the pawl latch pin.

5. The bifurcated latching system of claim 4 wherein the sleeve is slidable to move the pawl from the engaged position to disengage the pawl latch pin.

6. The bifurcated latching system of claim 4 wherein the pawl latch receptacle comprises a latch cam for moving the pawl from the engaged position to disengage the pawl latch pin.

7. The bifurcated latching system of claim 6 further comprising a sleeve coupled to the latch cam defining an aperture receiving the pawl, the latch cam configured to slide the sleeve relative to the pawl to move the pawl from the engaged position to disengage the pawl latch pin.

8. The bifurcated latching system of claim 4 wherein there are three pawls and the biasing means comprises three springs, each spring biasing a respective pawl, and wherein the pawl latch receptacle comprises means for moving the pawls from the engaged position to disengage the pawl latch pin.

9. The bifurcated latching system of claim 8 wherein the moving means comprises a sleeve and a latch cam coupled to the sleeve and configured to slide the sleeve relative to the pawl to disengage the pawl latch pin.

10. The bifurcated latching system of claim 4 wherein the pawl latch pin defines a groove for receiving the pawl when the pawl latch receptacle and the pawl latch pin are in mating engagement.

11. The bifurcated latching system of claim 4 wherein the pawl latch pin has an enlarged head defining a groove for receiving the pawl when the pawl latch receptacle and the pawl latch pin are in mating engagement.

12. The bifurcated latching system of claim 4 wherein the pin latch assembly further includes a pin rod and wherein the pin latch receptacle defines a pin latch receptacle bore to matingly receive the pin, the pin latch receptacle further defining a first pin rod channel and the pin defining a second pin rod channel, the pin rod receivable by the first and second pin rod channels when the pin is matingly received by the pin latch receptacle bore and when the first and second pin channels are aligned to secure in mating engagement the pin latch receptacle and the pin.

13. The bifurcated latching system of claim 12 wherein the pin latch receptacle housing has a guide member defining a guide bore contiguous with the pin latch receptacle bore for guiding the pin into the pin latch receptacle bore.

14. A bifurcated latching system for securing together first and second portions of an aircraft, the bifurcated latching system comprising: (a) a pin latch assembly comprising a pin latch receptacle having a first end for attachment to one of the first and second portions and a pin having a second end for attachment to the other of the first and second portions, the pin latch receptacle receiving the pin in mating relation, and locking means to secure the pin latch receptacle to the pin; and (b) a pawl latch assembly comprising a pawl latch receptacle having a first end for attachment to one of the first and second portions and including a pawl, a pawl latch pin having a second end for attachment to the other of the first and second portions, means for biasing the pawl to an engaged position, and means for moving the pawl from the engaged position, the pawl latch receptacle defining a pawl latch receptacle bore configured to receive the pawl latch pin to matingly engage the pawl latch receptacle and the pawl latch pin, the pawl biased by the biasing means to engage the pawl latch pin when the pawl latch pin is received by the pawl latch receptacle bore to secure in mating engagement the pawl latch receptacle and the pawl latch pin and to be moved by the moving means from the engaged position to unsecure the pawl latch receptacle from the pawl latch pin.

15. The bifurcated latching system of claim 14 wherein the moving means comprises a sleeve and a latch cam coupled to the sleeve configured to slide the sleeve relative to the pawl to unsecure the pawl from the pawl latch pin.

16. The bifurcated latching system of claim 14 wherein there are three pawls and the biasing means comprises three springs, each spring biasing a respective pawl.

17. A bifurcated latching system for securing together first and second portions of an aircraft, the bifurcated latching system comprising:

(a) a pin latch assembly comprising a pin latch receptacle having a first end for attachment to one of the first and second portions and a pin having a second end for attachment to the other of the first and second portions, the pin latch receptacle receiving the pin in mating relation, and locking means to secure the pin latch receptacle to the pin; and (b) a pawl latch assembly comprising a pawl latch receptacle having a first end for attachment to one of the first and second portions and including a plurality of pawls, a pawl latch pin having a second end for attachment to the other of the first and second portions, a plurality of springs for biasing the pawls to an engaged position, and means for moving the pawls from the engaged position, the pawl latch receptacle defining a pawl latch receptacle bore configured to receive the pawl latch pin to matingly engage the pawl latch receptacle and the pawl latch pin, the pawls biased by the springs to receive the pawl latch pin in mating engagement when the pawl latch pin is received by the pawl latch receptacle bore to secure in mating engagement the pawl latch receptacle and the pawl latch pin and to be moved by the moving means from the engaged position to unsecure the pawl latch receptacle from the pawl latch pin.

18. The bifurcated latching system of claim 17 wherein the moving means comprises a sleeve slidable relative to the pawls to disengage the pawls from the pawl latch pin.

19. The bifurcated latching system of claim 17 wherein the moving means comprises a latch cam for disengaging the pawls from the pawl latch pin.

20. The bifurcated latching system of claim 19 wherein the moving means further comprises a sleeve coupled to the latch cam, the latch cam configured to slide the sleeve relative to the pawls to disengage the pawls from the pawl latch pin.

* * * * *